US011091307B2

(12) United States Patent
Melby et al.

(10) Patent No.: US 11,091,307 B2
(45) Date of Patent: Aug. 17, 2021

(54) SUSPENSION APPARATUS FOR SUSPENDING AN ITEM

(71) Applicant: International Business Machines Corporation, Armonk, NY (US)

(72) Inventors: Justin Melby, Rochester, MN (US); Tate T. Harnack, Green, WI (US); Ryan Anderson, Rochester, MN (US); Benjamin Luedeman, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 133 days.

(21) Appl. No.: 15/952,078

(22) Filed: Apr. 12, 2018

(65) Prior Publication Data

US 2019/0315547 A1 Oct. 17, 2019

(51) Int. Cl.
*B65D 81/07* (2006.01)
*B65B 23/00* (2006.01)

(52) U.S. Cl.
CPC ..... *B65D 81/07* (2013.01); *B65B 23/00* (2013.01)

(58) Field of Classification Search
CPC ..... B65D 81/07; B65B 23/00; B65B 81/075
USPC ..... 206/583, 591, 594, 521, 592, 588, 497
See application file for complete search history.

(56) References Cited

U.S. PATENT DOCUMENTS 5,226,542 A 7/1993 Boecker et al.
5,251,760 A * 10/1993 Smith ..... B65D 5/5028 206/583
5,967,327 A 10/1999 Jones
6,073,761 A * 6/2000 Jones ..... B65D 5/5028 206/223
6,675,973 B1 1/2004 McDonald et al.
7,086,534 B2 8/2006 Roesel et al.
7,296,681 B2 11/2007 McDonald et al.
8,181,787 B2 5/2012 Klos
8,714,357 B2 5/2014 Ridgeway
8,727,123 B1 5/2014 Roberts
9,352,891 B2 5/2016 LeRoy et al.
9,932,162 B2 * 4/2018 Stack, Jr. ..... B65D 65/40
2006/0213803 A1 * 9/2006 Saitou ..... B65D 5/5035 206/583
2008/0223750 A1 * 9/2008 McDonald ..... B65D 5/5028 206/583
2009/0242448 A1 * 10/2009 Keiger ..... B65D 5/5028 206/478

(Continued)

FOREIGN PATENT DOCUMENTS

WO WO-2017083115 A1 * 5/2017 ..... B65D 5/4266

OTHER PUBLICATIONS

Sealed Air, "Suspension Packaging," 2018, pp. 1-3 retrieved from https://sealedair.com/product-care/product-care-products/suspension-packaging.

*Primary Examiner* — Rafael A Ortiz
(74) *Attorney, Agent, or Firm* — Zilka-Kotab, P.C.

(57) ABSTRACT

In one general embodiment, an apparatus includes a base having a face and back, a center section, and a foldable section extending from the center section. The apparatus further includes a perforated sheet extending along the face of the base, members extending from the foldable section for engaging perforations of the perforated sheet, and the foldable section being positioned to apply tension to the perforated sheet upon folding of the foldable section toward the back of the base.

19 Claims, 11 Drawing Sheets

(56) References Cited

U.S. PATENT DOCUMENTS

| | | | | |
|---|---|---|---|---|
| 2011/0240515 | A1* | 10/2011 | Ridgeway | B65D 5/5028 206/583 |
| 2014/0183097 | A1* | 7/2014 | LeRoy | B65D 75/305 206/583 |
| 2015/0314936 | A1* | 11/2015 | Stack, Jr. | B65D 5/5035 206/488 |
| 2016/0101923 | A1 | 4/2016 | Costanzo, Jr. | |
| 2018/0141700 | A1* | 5/2018 | Ridgeway | B65B 49/14 |

* cited by examiner

SUSPENSION APPARATUS FOR SUSPENDING AN ITEM

FIELD OF THE INVENTION

The present invention relates to products for protecting an item, and more particularly, this invention relates to a suspension apparatus for suspending an item, e.g., during shipping, for protecting the item from being damaged.

BACKGROUND

Shipping of items to a consumer as opposed to the consumer picking up the item at the site at which the item was produced or sold is becoming more prevalent than ever before. Accordingly, protecting items during shipping is important because when a shipped item is received by the consumer damaged, the consumer will likely demand a replacement or refund. Depending on the warranty of the item, the party that shipped the item often is responsible for facilitating a return of the damaged item, and shipping a replacement item or repaired item to the consumer. This is a time consuming and sometimes very expensive process.

Past efforts made to protect an item during shipping have included use of a continuous plastic film that is wrapped tightly around the item and a frame in an attempt to prevent the item from impacting the sides of a box that holds the item and frame. Items have been found to tear through such plastic sheets however, thereby allowing the item to come free of the plastic sheet in the box, and as a result lose protection from impacts within the box. Moreover, protruding parts of the now-loose item may even puncture through the box, resulting in further damage.

Other past efforts made to protect an item during shipping include suspending an item between shock absorption members in a shipping container, where the shock absorption members are adhered to the container via adhesive strips. Such efforts however are also susceptible to failure, e.g., as a result of the item tearing free of the suspension members, and thereafter impacting a side of the box.

Moreover, using a single piece of cardboard folded to suspend an item within a box has also been used in an attempt to protect an item from impacting a side of the box during shipping. Such packaging types however are problematic in that portions of shipped items (such as sharp edges of an item) have been found to puncture through the cardboard, upon which the portion of the item may contact a side of the box or a surface on which the box is placed and become damaged.

Accordingly, past efforts to protect an item during shipping are prone to a variety of issues. Moreover, the frequency in which items are damaged is notable, because during shipping of an item, the box containing the packaged item is often handled numerous times.

SUMMARY

An apparatus according to one embodiment includes a base having a face and back, a center section, and a foldable section extending from the center section. The apparatus further includes a perforated sheet extending along the face of the base, members extending from the foldable section for engaging perforations of the perforated sheet, and the foldable section being positioned to apply tension to the perforated sheet upon folding of the foldable section toward the back of the base. The apparatus further includes a second foldable section extending from the center section in a direction opposite the foldable section. The second foldable section includes members for engaging perforations of the perforated sheet. The second foldable section is positioned to apply tension to the perforated sheet upon folding of the second foldable section toward the back of the base. The base includes third and fourth foldable sections configured to fold toward the face of the base.

The apparatus is configured to suspend an item in an interior of a box during shipping and thereby protect the item. One of the numerous protections offered by the apparatus includes protecting said item from impacting a side of the box. Specifically, the perforations of the perforated sheet prevent the item from damaging the perforated sheet. Moreover, any sharp or pointed portions of the item, such as a tip of the corner of the item, pass through one or more perforations of the perforated sheet. Accordingly, the pointed corner of the item is prevented from tearing or ripping the perforated sheet, yet tension keeps the perforated sheet in contact with other portions of the item thereby securing the item. Moreover, if the box containing the apparatus and suspended item impacts a surface, such as the ground, the item remains suspended and does not impact any sides of the box. As a result, damage to the item becomes very unlikely during shipping. Thus, expenses associated with having to repair a damaged item or having to ship a replacement item are avoided.

An apparatus according to another embodiment includes a box, and a suspension apparatus for positioning in an interior of the box. The suspension apparatus includes a base having a face and back, a center section having a periphery approximately equal to a periphery of the interior of the box, and a foldable section extending from the center section. The suspension apparatus further includes a perforated sheet extending along the face of the base, members extending from the foldable section for engaging perforations of the perforated sheet, and a suspension portion for suspending the center section above a bottom of the box. The foldable section is positioned to apply tension to the perforated sheet upon folding of the foldable section toward the back of the base. The suspension apparatus further includes a second foldable section extending from the center section in a direction opposite the foldable section. The second foldable section includes members for engaging perforations of the perforated sheet. The second foldable section is positioned to apply tension to the perforated sheet upon folding of the second foldable section toward the back of the base.

The apparatus is configured to suspend an item in an interior of the box during shipping and thereby protect the item. One of the numerous protections offered by the apparatus includes protecting said item from impacting a side of the box. Specifically, the perforations of the perforated sheet prevent the item from damaging the perforated sheet. Moreover, any sharp or pointed portions of the item, such as a tip of the corner of the item, pass through one or more perforations of the perforated sheet. Accordingly, the pointed corner of the item is prevented from tearing or ripping the perforated sheet, yet tension keeps the perforated sheet in contact with other portions of the item. Moreover, if the box containing the apparatus and suspended item impacts a surface, such as the ground, the item remains suspended and does not impact any sides of the box. As a result, damage to the item becomes very unlikely during shipping. Thus, expenses associated with having to repair a damaged item or having to ship a replacement item are avoided.

A method for packaging an item in a suspension apparatus according to one embodiment includes positioning an item on a face of a base of the suspension apparatus. The base includes the face and a back, a center section, and a foldable section extending from the center section. The method further includes covering an exposed side of the item with a perforated sheet extending along the face of the base, engaging members extending from the foldable section of the base with at least some apertures of the perforated sheet, and folding the foldable section of the base toward the back of the base. Tension is applied to the perforated sheet as a result of the folding. The method further includes engaging members extending from a second foldable section of the base with at least some apertures of the perforated sheet, and folding the second foldable section of the base toward the back of the base. Tension is applied to the perforated sheet as a result of the folding of the second foldable section. The method further includes folding third and fourth foldable sections of the base toward the face of the base, and positioning the suspension apparatus in an interior of a box. In the interior of the box, the third and fourth foldable section suspend the center section above a bottom of the box.

Using the method for packaging an item in a suspension apparatus allows the item to be suspended in an interior of a box for protecting the item during shipping. One of the numerous protections offered by the method includes protecting said item from impacting a side of the box by placing the item in an apparatus, e.g., as described above.

Other aspects and advantages of the present invention will become apparent from the following detailed description, which, when taken in conjunction with the drawings, illustrate by way of example the principles of the invention.

DETAILED DESCRIPTION

Figure 1A:
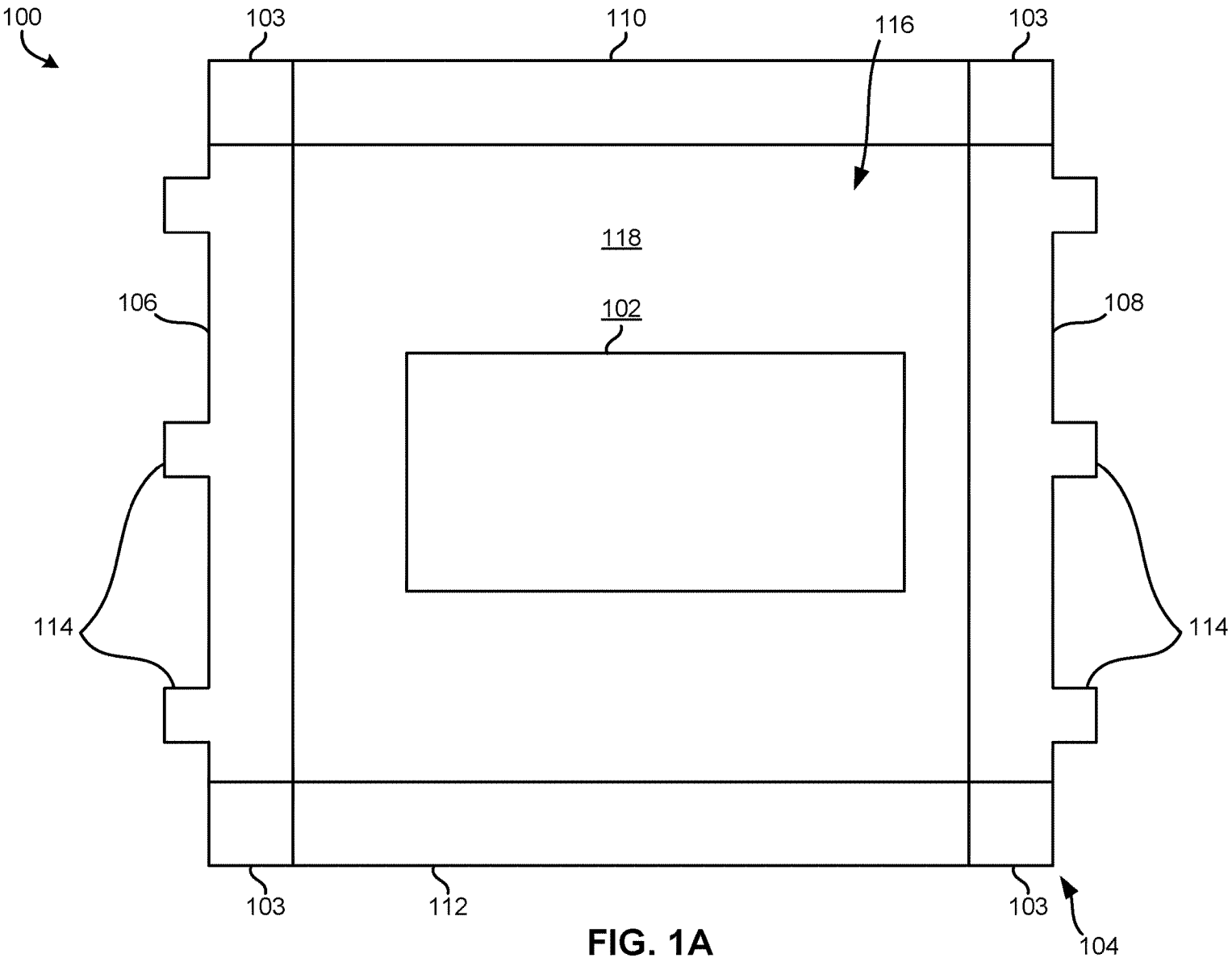
FIG. 1A is a face side view of a base and an item.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

The following description discloses several preferred approaches and/or embodiments of apparatuses for suspending an item, e.g., during shipping for protecting the item from being damaged.

In one general embodiment, an apparatus includes a base having a face and back, a center section, and a foldable section extending from the center section. The apparatus further includes a perforated sheet extending along the face of the base, members extending from the foldable section for engaging perforations of the perforated sheet, and the foldable section being positioned to apply tension to the perforated sheet upon folding of the foldable section toward the back of the base.

In another general embodiment, an apparatus includes a box, and a suspension apparatus for positioning in an interior of the box. The suspension apparatus includes a base having a face and back, a center section having a periphery approximately equal to a periphery of the interior of the box, and a foldable section extending from the center section. The suspension apparatus further includes a perforated sheet extending along the face of the base, members extending from the foldable section for engaging perforations of the perforated sheet, and a suspension portion for suspending the center section above a bottom of the box. The foldable section is positioned to apply tension to the perforated sheet upon folding of the foldable section toward the back of the base.

In yet another general embodiment, a method for packaging an item in a suspension apparatus includes positioning an item on a face of a base of the suspension apparatus. The base includes the face and a back, a center section, and a foldable section extending from the center section. The method further includes covering an exposed side of the item with a perforated sheet extending along the face of the base, engaging members extending from the foldable section of the base with at least some apertures of the perforated sheet, and folding the foldable section of the base toward the back of the base. Tension is applied to the perforated sheet as a result of the folding.

During shipping of an item from one location to another, a box containing the item is often handled numerous times. Accordingly, during shipping, the box often experiences impact forces resulting from any one or more of bumps, drops, shaking, etc. It is important to protect the item packaged in the box as much as possible from being damaged from such forces. Despite longstanding attempts to protect items during shipping, many items are delivered to consumers damaged. Often, damage results when portions of the item, such as sharp edges, puncture and/or tear through the protective structures intended to prevent the item from impacting the sides of the box during shipping.

Various embodiments described herein include a perforated sheet for suspending an item in a box during shipping and thereby protecting the item, e.g., from impacting a side of the box. Perforations of the perforated sheet prevent the item from damaging the perforated sheet. Accordingly, when the box containing the suspended item impacts a surface, such as the ground, the item will remains suspended and will not impact any sides of the box. As a result, damage to the item becomes very unlikely during shipping.

FIGS. 1A-1G depict an apparatus 100 for, e.g., preventing an item from being damaged during shipping, in accordance with one embodiment. As an option, the present apparatus 100 may be implemented in conjunction with features from any other embodiment listed herein, such as those described with reference to the other FIGS. Of course, however, such apparatus 100 and others presented herein may be used in various applications and/or in permutations which may or may not be specifically described in the illustrative embodiments listed herein. Further, the apparatus 100 presented herein may be used in any desired environment.

Referring now to FIG. 1A, apparatus 100 includes a base 104. The base 104 includes a face 116 and a back. It should be noted that the back of the base 104 is obstructed from view in FIG. 1A, but resides on an opposite side of the base 104 as the face 116, e.g., see the back 124 of the base 104 in FIG. 1D.

Moreover the base 104 includes a center section 118, and a foldable section 106 extending from the center section 118. According to various approaches, the center section 118 is at least as spatially large as an item 102 that the apparatus 100 will protect from being damaged during shipping. As used herein, the term "shipping" is intended to encompass any transportation and/or handling of an item. Note that the manner in which the apparatus 100 is configured to protect the item 102 from being damaged during shipping will become readily apparent in the descriptions of FIGS. 1A-1G and various other approaches and embodiments described herein.

In one approach, the base 104 may include a second foldable section 108 extending from the center section 118 in a direction opposite the foldable section 106.

At least one of the foldable sections 106, 108 may include members 114 extending from the foldable section.

Moreover, the base includes third and fourth foldable sections 110, 112 configured to fold toward the face 116 of the base 104.

It should be noted that at least one of the foldable sections 106, 108 may include portions 103 which are configured to fold with a respective foldable sections 106, 108. In some approaches, the portions 103 may additionally be configured to fold with the third and fourth foldable sections 110, 112, e.g., see FIGS. 1E-1F.

Figure 1B:
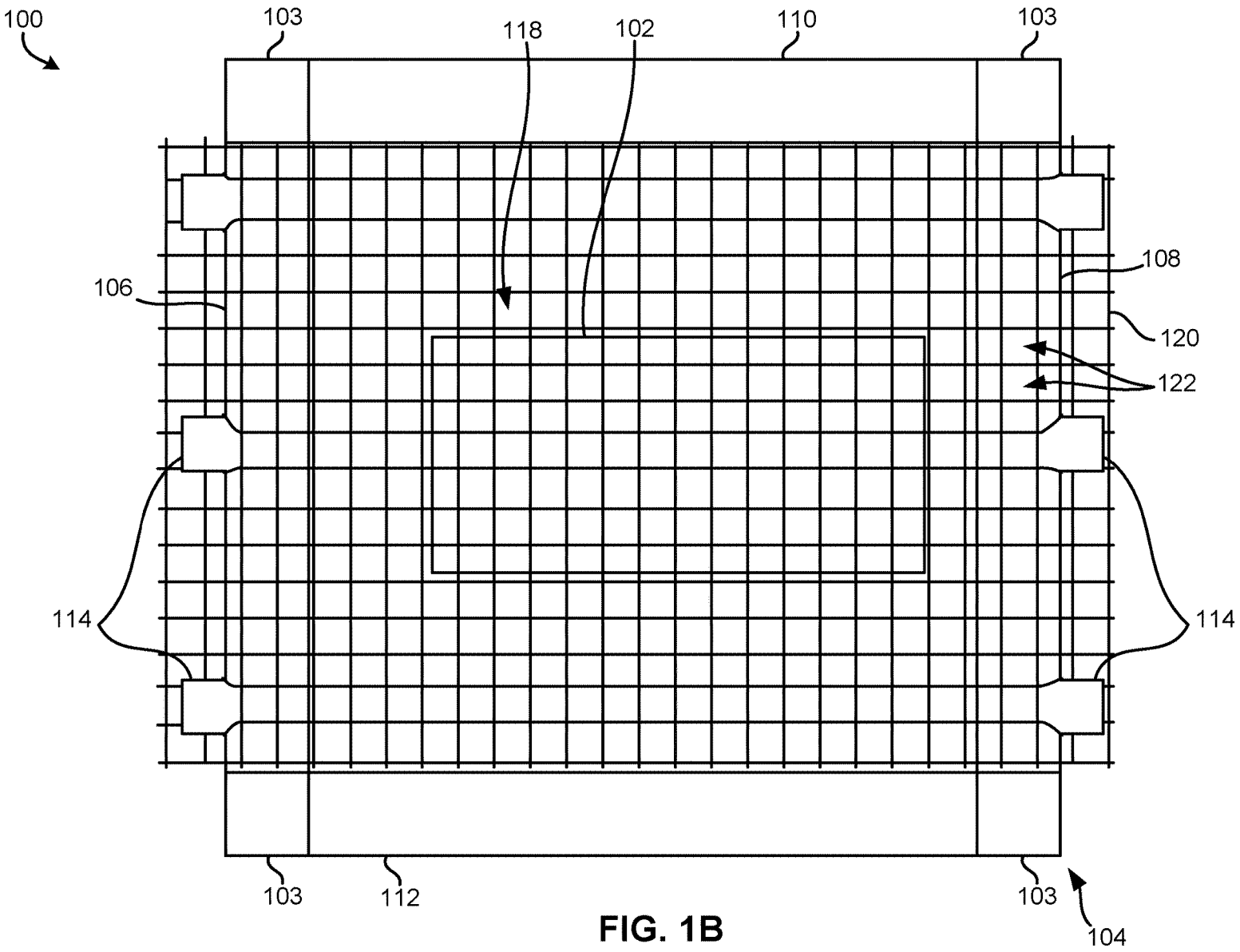
FIG. 1B is a face side view of the base and item of FIG. 1A with a perforated sheet.
Figure 1G:
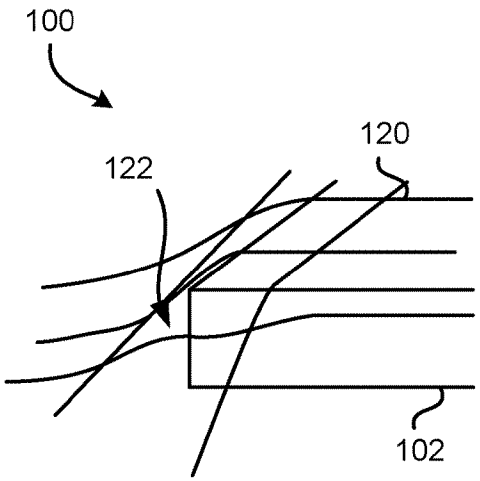
FIG. 1G is a partial perspective view taken from circle 1G of FIG. 1C.

With various portions of the base 104 now described, referring now to FIG. 1B, the manner in which the apparatus 100 prevents item 102, from being damaged during shipping will now become apparent.

As illustrated in FIG. 1B, apparatus 100 includes a perforated sheet 120 extending along the face 116 of the base 104.

In some approaches, the perforated sheet 120 may include a resiliently deformable material that stretches when tension is applied thereto, e.g., to provide cushioning for the item. The extent of deformation and/or degree of resilience associated with the perforated sheet 120 may be selected as appropriate for the intended use, as would be appreciated by one skilled in the art upon reading the present description. In other approaches, the perforated sheet 120 may include a substantially resilient material.

In one specific approach, the perforated sheet 120 may include rubber material. According to another specific approach, the perforated sheet 120 may additionally and/or alternatively include known rope and/or thread materials, such as monofilament, braided threads, etc. According to yet another specific approach, the perforated sheet 120 may additionally and/or alternatively include a known plastic material.

The perforated sheet 120 may include any type of perforations, e.g., see perforations 122. For example, according to one approach, the perforated sheet 120 may include regularly spaced apertures across an entire area thereof. Accordingly, to another approach, the perforated sheet 120 may additionally and/or alternatively be netting.

According to some approaches, the perforated sheet 120 may include apertures in particular portions thereof.

According to one approach, the perforated sheet 120 may extend along the face 116 of the base 104 and past the foldable sections 106, 108 to allow the members 114 to engage the perforations 122 of the perforated sheet 120. For example, in the present approach each of the members 114 are fingers extending outwardly from the foldable section along a plane thereof. Accordingly, the members 114 may pass through a respective perforation 122 of the perforated sheet 120 where the contour of each of the respective engaged perforations thereafter wrap around about the location where the members 114 extend from the foldable sections 106, 108.

However, according to various approaches, the members 114 may be any type of shape that allows the members 114 to engage the perforations 122 of the perforated sheet 120. For example, in one approach, the members 114 may additionally and/or alternatively include hooks, e.g., see FIGS. 4A-4D. In another approach, the members 114 may additionally and/or alternatively include pins, e.g., pins that may be coupled to at least one of the foldable sections 106, 108 and/or the center section 118 of the base 104. In a further approach, the members 114 may additionally and/or alternatively include slits, e.g., where each slit is configured to at least temporarily retain at least a portion of the of the perforated sheet 120 upon receiving the perforated sheet 120 therein. In yet another approach, the members 114 may additionally and/or alternatively include a clip that is configured to at least temporarily retain at least a portion of the of the perforated sheet 120 upon selectively engaging with the perforated sheet 120.

In the present approach, the foldable sections 106, 108 are each positioned to apply tension to the perforated sheet 120 upon folding of one or both of the foldable sections 106, 108 toward the back of the base 104. For example, referring now to FIG. 1C, the foldable sections 106, 108 are folded toward the back of the base 104 and therefore are obstructed from view in FIG. 1C.

It should be noted that the amount of tension applied to the perforated sheet 120 upon folding of one or both of the foldable sections 106, 108 toward the back of the base 104 may vary, e.g., depending on the size of the perforated sheet 120, depending on which of the perforations 122 of the perforated sheet 120 the members 114 engage with, depending on the spatial dimensions of the foldable sections 106, 108, etc.

According to various approaches, the tension applied to the perforated sheet 120 upon folding of one or both of the foldable sections 106, 108 toward the back of the base 104 may thereby secure the item 102 against the center section 118. Specifically, in some approaches, the tension applied to the perforated sheet 120 upon folding of one or both of the foldable sections 106, 108 toward the back of the base 104 may prevent the item 102 from being able to easily slide to an outer periphery of the center section 118, e.g., retaining the item 102 during shaking or tilting of the base 104.

It should be noted that the perforations 122 of the perforated sheet 120 are configured to prevent portions of the item 102 from puncturing or tearing the perforated sheet 120. For example, in some approaches, the perforations 122 of the perforated sheet 120 may be configured to allow corners, sharp edges, plugs, etc., of the item to partially pass therethrough. For example, referring to FIG. 1G, which is a partial perspective view taken from circle 1G of FIG. 1C, there is shown the perforated sheet 120 partially wrapping the corner of the item 102. It should be particularly noted that the tip of the corner of the item does not contact the perforated sheet 120, but rather passes through a particular perforation 122 of the perforated sheet 120. Accordingly, the pointed corner of the item 102 is prevented from tearing or ripping the perforated sheet 120, yet tension keeps the perforated sheet 120 in contact with other portions of the item 102, e.g., non-pointed surfaces of the item 102, to reinforce the placement of the item 102 on the center section 118 of the base 104. These benefits offer numerous advantages in sharp contrast to conventional packing types which are prone to portions of items tearing through continuous sheets of packing materials during shipping of the item, which is problematic as the item is thereafter able to impact the sides of a box that the item is being shipped in. An item impacting the side of a box will likely result in damage to the item. Accordingly, the benefits and advantages offered by the perforated sheet 120 of apparatus 100 can mitigate the significant costs associated with having to repair or replace items that are damaged during shipping.

Figure 1C:
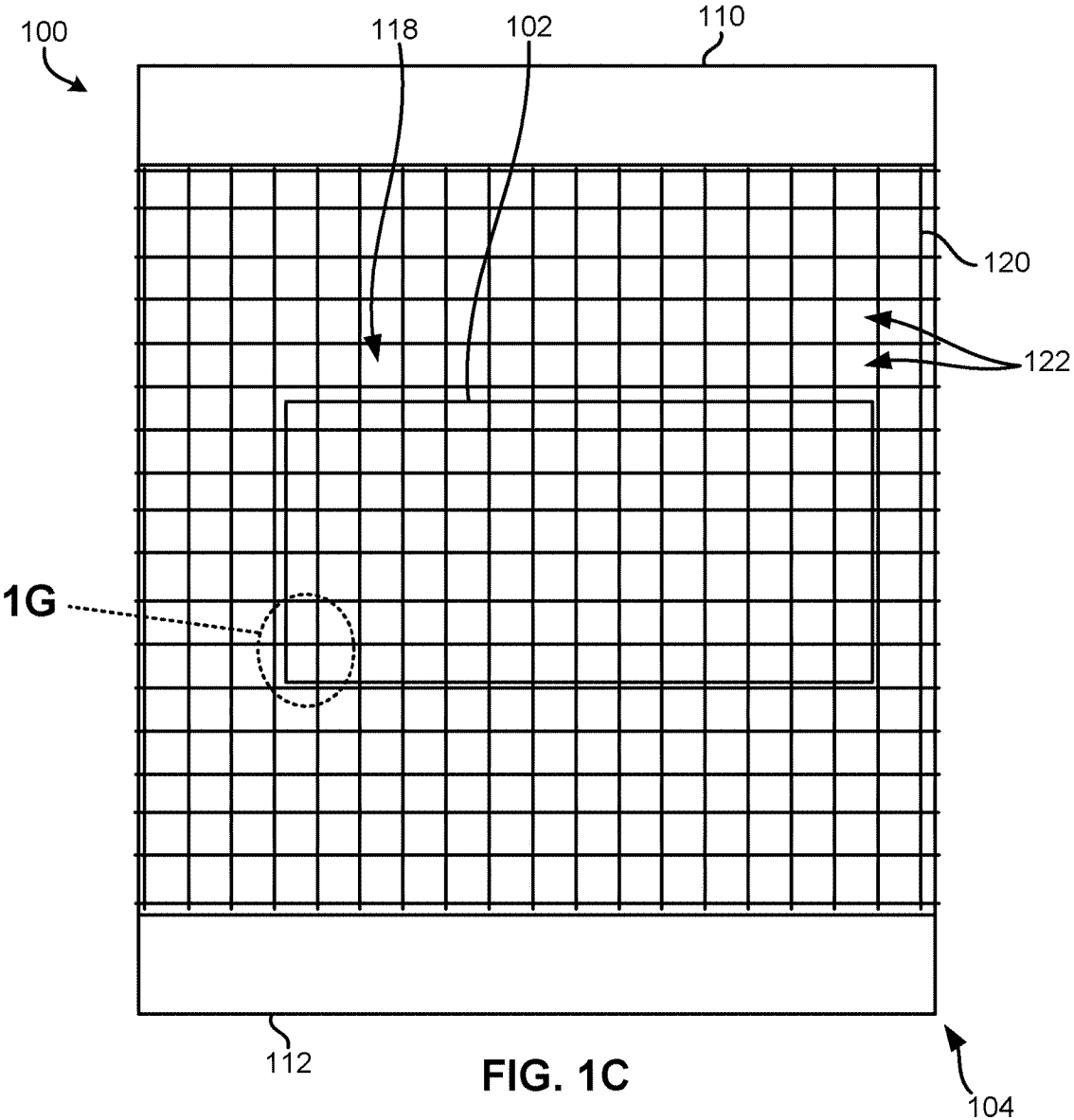
FIG. 1C is a face side view of the base, item and perforated sheet of FIGS. 1A-1B, with foldable sections of the base folded toward a back of the base.
Figure 1D:
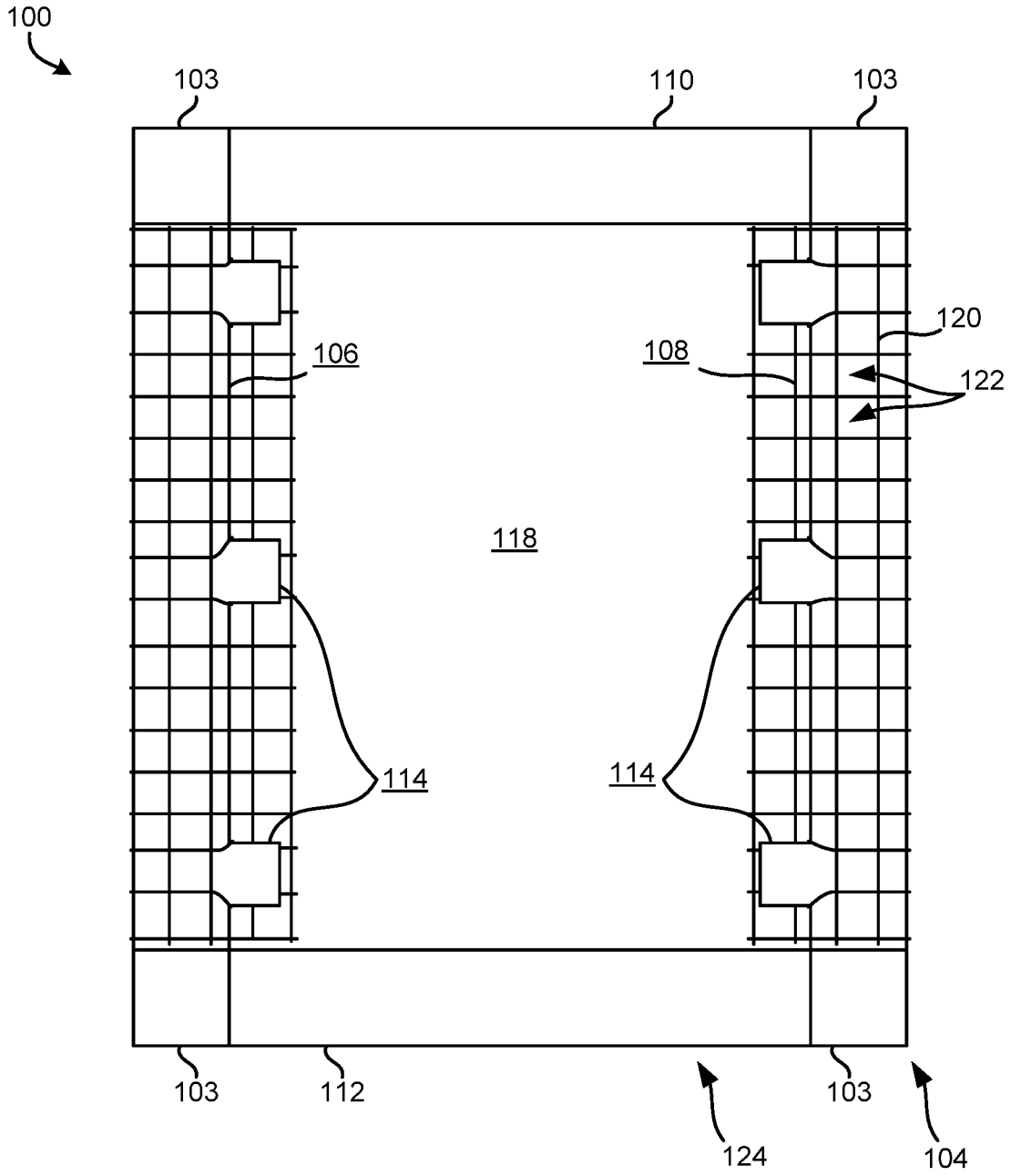
FIG. 1D is a back side view of the base of FIGS. 1A-1C, with the foldable sections of the base folded to the back of the base.

Referring now to FIG. 1D, the back 124 of the base 104 is illustrated. Moreover, the foldable sections 106, 108 are shown folded toward the back 124 of the base 104.

According to some approaches, the back of the base may include a coupling component for selectively coupling the foldable sections 106, 108 to the back 124 of the base 104. For example, according to one approach, the selectively coupling may be established by the foldable sections 106, 108 and/or the back 124 including an adhesive strip, e.g., see adhesive strip 201 and adhesive strip 203 of FIGS. 2B-2C. According to another approach, the selectively coupling may be established by the foldable sections 106, 108 and/or the back 124 including a latch of a known type that would be appreciated by one skilled in the art upon reading the present descriptions. According to yet another approach, the selectively coupling may be established by the foldable sections 106, 108 and/or the back 124 including a clip of a type that would be appreciated by one skilled in the art upon reading the present descriptions.

Figure 1E:
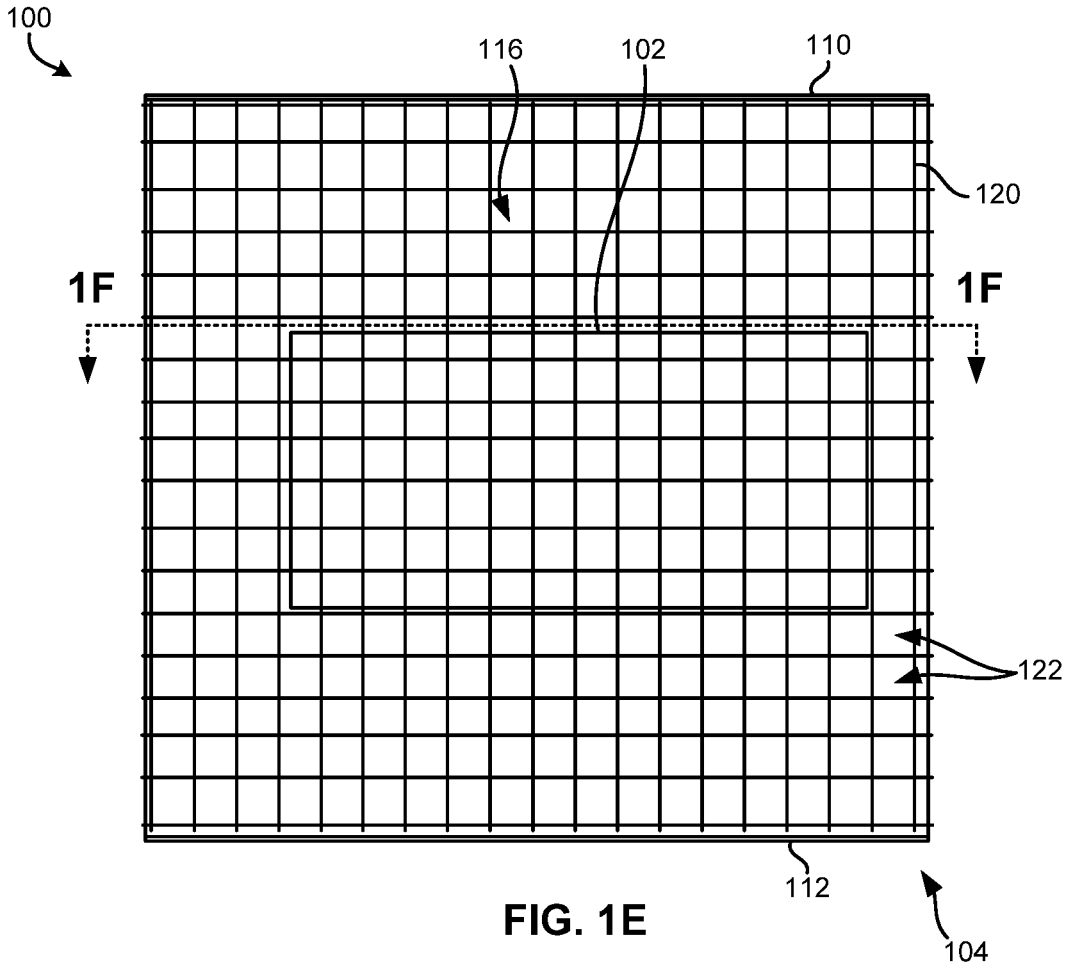
FIG. 1E is a face side view of the base of FIGS. 1A-1D, with second foldable sections of the base folded toward the face of the base.

Referring now to FIG. 1E, the face 116 of the base 104 is illustrated. The third and fourth foldable sections 110, 112 are shown folded toward the face 116 of the base 104, e.g., extending out of the page in a direction about perpendicular with the face 116 of the base 104. Moreover, the foldable sections 106, 108 are hidden from view, folded to the back of the base 104.

Figure 1F:
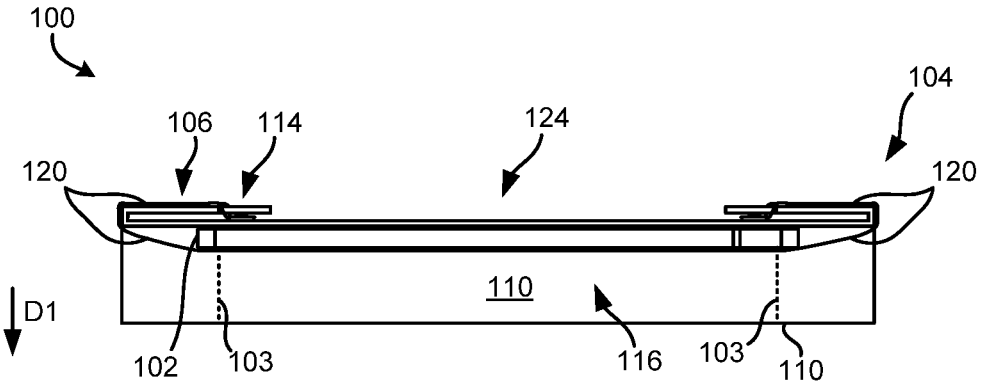
FIG. 1F is a cross-sectional side view taken along line 1F of FIG. 1E.

FIG. 1F is a cross-sectional side view of the base 104 of apparatus 100, taken along line 1F. As shown, the tension applied to the perforated sheet 120 upon folding of the foldable sections 106, 108 toward the back 124 of the base 104 may suspend the item 102 from the base 104 when the center of the base 104 is positioned above the item 102 and placed in a box for shipping. Suspending of an item, e.g., for protecting the item during shipping and/or handling, will be described in greater detail elsewhere herein, e.g., see FIGS. 2A-4D.

It should be noted that although the perforated sheet 120 is illustrated to suspend the item 102 while keeping the item in contact with the face 116 of the base 104 in FIG. 1F, according to other approaches, the perforated sheet 120 may suspend the item 102, in a direction Dl, such that a gap is created between the item 102 and the face 116 of the base 104. However, such loose suspension renders the item more susceptible to shifting during movement.

Referring again to FIG. 1B, another benefit of the perforated sheet 120 is that the amount of perforated sheet 120 extending between the members 114 of the base 104 may be adjusted depending on the spatial parameters of the item 102. For example, in order to suspend an item that is larger than the item 102, the members 114 of the foldable sections 106, 108 may engage perforations 122 of the perforated sheet 120 that reside closer to the outer circumference of the perforated sheet 120 than the perforations that are engaged in the drawing. Accordingly, engaging perforations 122 of the perforated sheet 120 that reside closer to the outer circumference of the perforated sheet 120 than the perforations 120 that are engaged in the current approach to suspend item 102 allow the perforated sheet 120 to wrap around such larger items. Conversely, for smaller items, the members 114 may engage perforations residing farther from the outer circumference of the perforated sheet 120.

It should be noted that although the base 104 of apparatus 100 is illustrated to include two foldable sections 106, 108 configured to apply tension to the perforated sheet 120 upon folding of the foldable sections 106, 108 toward the back 124 of the base 104, in some approaches, the apparatus may alternatively include only a single foldable section for engaging perforations 120 of the perforated sheet 120, e.g., see FIGS. 4A-4D, which are described in more detail below.

With general reference to FIGS. 1A-1F, for reference, it should be noted that in the transition from FIG. 1C to FIG. 1F, the portions 103 may be folded first with the foldable sections 106, 108 toward the back 124 of the base 104, e.g., as in FIGS. 1C-1D, and then folded with the foldable sections 110, 112 toward the face 116 of the base 104, e.g., as in FIGS. 1E-1F. However, in other approaches, the base 104 may not include the portions 103, e.g., to save space and/or material when fabricating the base 104. In yet further approaches, the portion 103 may extend from outer portions 110, 112.

Figure 2A:
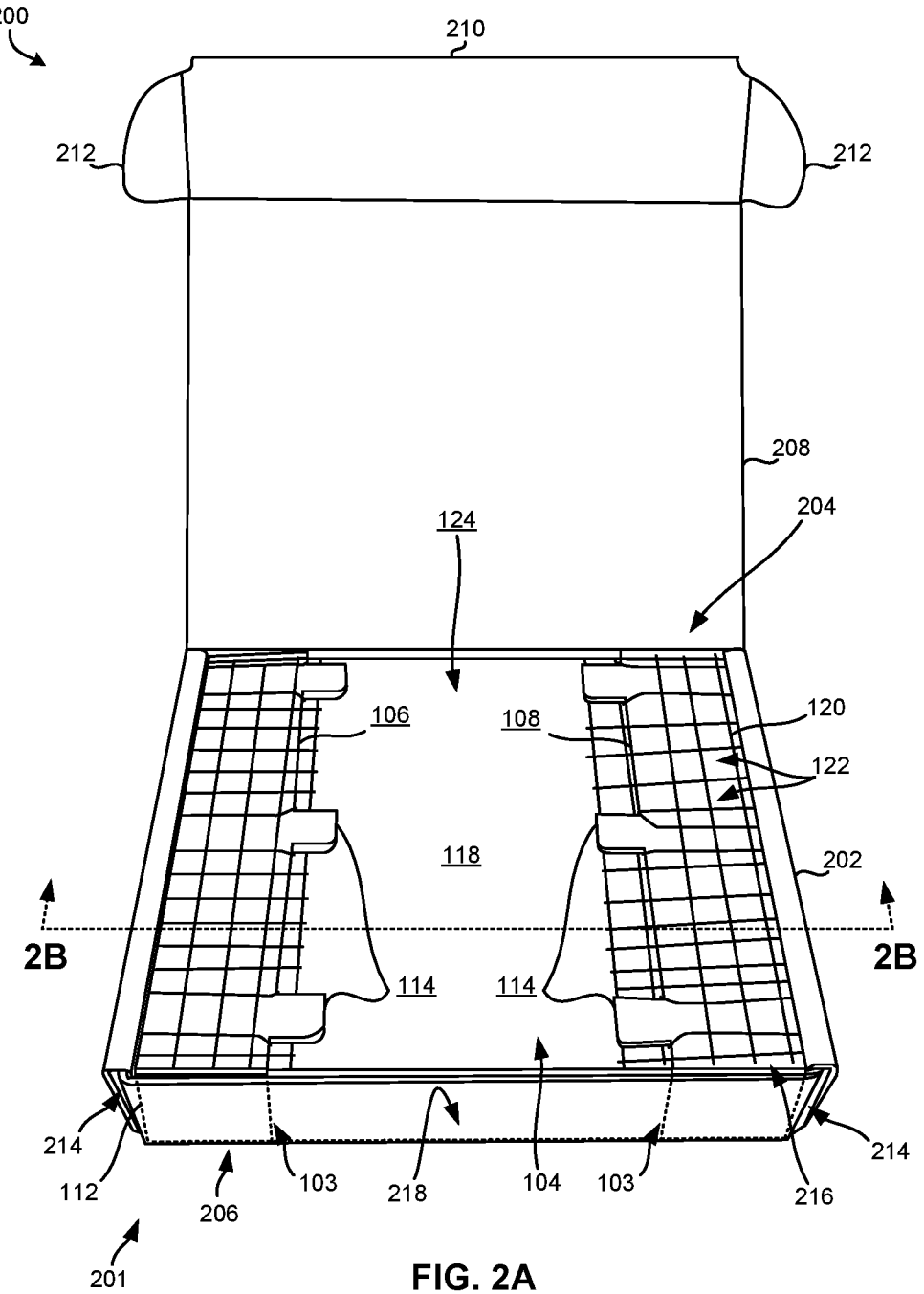
FIG. 2A is a perspective view of a base and perforated sheet in an interior of a box.
Figure 2B:
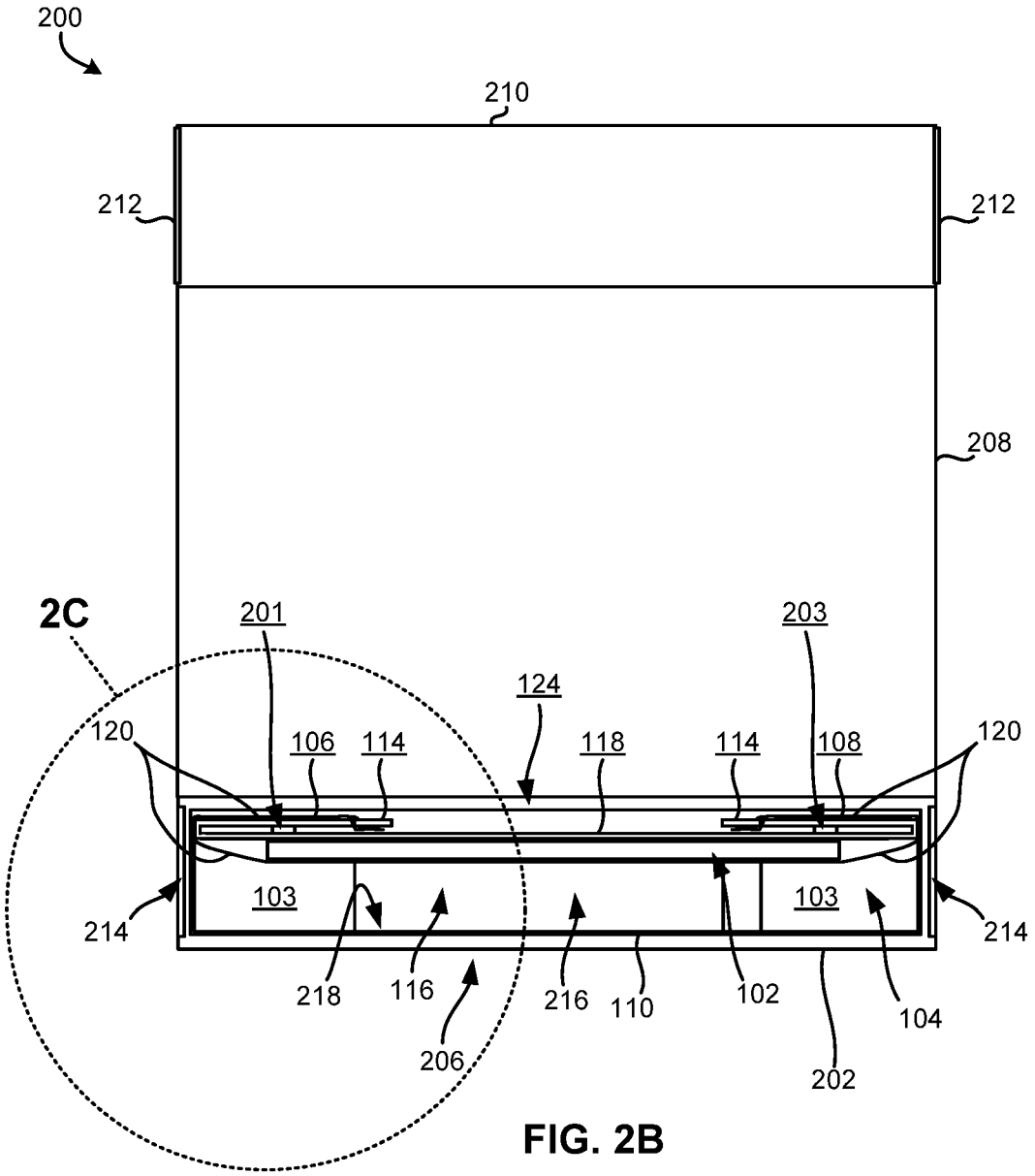
FIG. 2B is a cross-sectional view taken along line 2B of FIG. 2A.
Figure 2C:
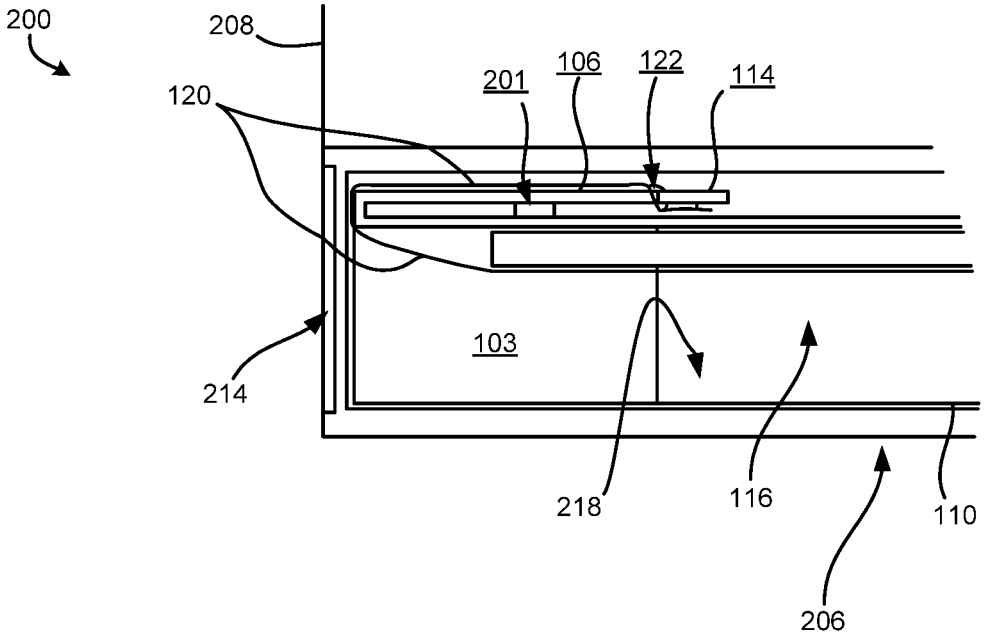
FIG. 2C is an enlarged view taken from circle 2C of FIG. 2B.

FIGS. 2A-2C depict an apparatus 200, in accordance with one embodiment. As an option, the present apparatus 200 may be implemented in conjunction with features from any other embodiment listed herein, such as those described with reference to the other FIGS. Of course, however, such apparatus 200 and others presented herein may be used in various applications and/or in permutations which may or may not be specifically described in the illustrative embodiments listed herein. Further, the apparatus 200 presented herein may be used in any desired environment.

It should be noted that apparatus 200 of FIGS. 2A-2C may be similar to apparatus 100 of FIGS. 1A-1G. Accordingly, the numbering of various portions of apparatus 200 share common numbering with similar portions of apparatus 100 described elsewhere herein.

Referring now to FIG. 2A, apparatus 200 includes a box 202. The box 202 may be of any type, size and configuration. According to one approach, the box 202 may include an interior 204, e.g., defined by a bottom 206, and a peripheral sidewall extending upwardly from the bottom 206. The box may also include a top 208.

In the approach shown, the box 202 includes a flap 210 with ears 212. The ears 212 of the flap 210 may be configured for engaging with slits 214 of the box 202, for keeping the box in a closed configuration. Accordingly, to close the box 202, the top 208 and flap 210 may be folded down to cover the interior 204 of the box 202 and secured in the closed position upon the ears 212 engaging with the slits 214.

According to various approaches, the box 202 may be composed of any one or more types of materials. For example, in one approach, the box 202 may be composed of cardboard or any other type of corrugated material, e.g., B-flute, C-flute, etc. In other approaches, the box 202 may additionally and/or alternative be composed of known impact absorbing foam materials. In yet other approaches, the box 202 may additionally and/or alternative be composed of plastic, e.g., low-density polyethylene thermoplastics, high-density polyethylene thermoplastics, recyclable/biodegradable plastics such as polylactic acid, reusable rigid plastic, etc. In yet other approaches, the box 202 may additionally and/or alternative be composed of an organic biodegradable product, e.g., corn-based products that disintegrate in a landfill.

Apparatus 200 also includes a suspension apparatus 216 for positioning in the interior 204 of the box 202. The suspension apparatus 216 may have any configuration described herein, and in the particular embodiment shown, is similar to the apparatus 100 of FIGS. 1A-1G.

With continued reference to FIG. 2A, the suspension apparatus 216 includes a base 104. The base 104 includes a back 124, a face (partially shown but primarily residing on the opposite side of the base 104 as the back 124), and a center section 118.

According to one approach, the center section 118 of the base 104 may have a periphery approximately equal to, e.g., slightly smaller than, a periphery of the interior 204 of the box 202. This size of center section periphery helps secure the suspension apparatus 216 while in the interior 204 of the box 202. For example, the approximately equal peripheries may prevent the suspension apparatus 216 from moving laterally about the interior of the box 202, e.g., such as during shipping of the suspension apparatus 216 and the box 202. Preventing movement of the suspension apparatus 216 about the interior 204 of the box 202 may help prevent an item (see item 102 of FIGS. 2B-2C) suspended in the suspension apparatus 216 from contacting any interior surface of the box 202, e.g., during shipping. As described elsewhere herein, an item contacting an interior surface of a box during shipping often causes damage to the item. Accordingly, the cooperating peripheries of the center section 118 and the interior of the box 202 in various approaches may greatly assist in preventing damage of suspended items during shipping.

The base 104 additionally includes at least one foldable section 106 extending from the center section 118. Moreover, a second foldable section 108 also extends from the center section 118 in the approach depicted. Preferably, the second foldable section 108 extends from the center section 118 in a direction opposite the foldable section 106.

According to preferred approaches, the suspension apparatus 216 includes a perforated sheet 120 extending along the face of the base 104. It should be noted that because the back 124 of the base 104 is shown in FIG. 2A, while the face of the base 104 resides hidden from view in the interior 204 of the box 202 portions of the perforated sheet 120 that extend along the center section of the face of the base 104 are hidden from view except those portions of the perforated sheet 120 that extend along the foldable sections 106, 108. Accordingly, only a partial view of the perforated sheet 120 is visible in FIG. 2A, e.g., see the outer portions of the perforated sheet 120 shown folded toward the back 124 of the base 104 with the foldable sections 106, 108.

The suspension apparatus 216 includes members 114 extending from the foldable sections 106, 108 for engaging perforations 122 of the perforated sheet 120. According to one approach, the foldable sections 106, 108 may be positioned to apply tension to the perforated sheet 120 upon folding of the foldable sections 106, 108 toward the back 124 of the base 104. For example, referring now to FIG. 2B, the foldable sections 106, 108 are each folded to the back 124 of the base 104. Accordingly, tension is applied to the perforated sheet 120, thereby suspending the item 102 from a bottom 218 of the box 202.

Moreover, the suspension apparatus 216 may include a suspension portion 201 for suspending the center section 118 above a bottom 218 of the box 202. Preferably, a length of the suspension portion 201 between the center section 118 and the bottom of the box when properly assembled is greater than a greatest length of the suspended item 102 as measured in the same direction, thereby preventing the suspended item 102 from engaging the bottom 218 of the box 202.

In one approach, as illustrated in FIGS. 2A-2C, the suspension portion 201 of the suspension apparatus 216 may include foldable sections 112, 110 extending from the base 104. The foldable sections 112, 110 may be foldable toward the face 116 of the base 104. For example, the foldable section 112 is shown folded toward the face 116 of the base 104 in FIG. 2A, and the foldable section 110 is shown folded toward the face 116 of the base 104 in FIG. 2B-2C.

In another approach, the suspension portion may additionally and/or alternatively include legs extending from the base 104, as will be detailed elsewhere herein, e.g., see FIGS. 4A-4D.

Referring again to FIG. 2B, the suspension apparatus 216 may be positioned in the interior 204 of the box 202 with the face 116 of the base 104 facing the bottom 218 of the box 202. Note that damage to the item 102 during shipping or movement of the suspension apparatus 216 and the box 202 is prevented by the suspension portion 201 (foldable sections 112, 110) of the suspension apparatus 216 preventing the item 102 from contacting the bottom 218 of the box 202. Moreover, damage to the item 102 is additionally and/or alternatively prevented by the perforated sheet 120 suspending and partially wrapping the item 102, thereby preventing the item 102 from contacting the bottom 218 and/or a side of the box 202. For example, the item 102 will not contact any interior surface of the box 202 upon the box 202 being dropped, shaken, struck, etc., during shipping.

As described above, the perforations of the perforated sheet 120 prevent the item 102 from tearing through the perforated sheet 120, which would thereafter otherwise reduce or eliminate the protective function of the suspension apparatus 216. For example, the perforations of the perforated sheet 120 may be configured to allow various portions of the item 102, e.g., pointed portions such as corners, jagged portions, pins, etc., to partially pass through the apertures in the perforated sheet 120.

Various materials usable in the suspension apparatus 216 are more environmentally friendly, easily reusable, and less expensive than many conventional packing/shipping materials. Moreover, in sharp contrast to some conventional packing/shipping materials, such as foams which require custom molding, the components of various approaches herein may be reused in shipping items of varying size.

These advantages should be considered especially in view of conventional shipping techniques, which are plagued with events in which portions of items puncture and/or tear through the shipping materials, e.g., such as plastic sheets.

The top 208 of the box 202 is shown in an open position in FIGS. 2A-2C. In the open position, the suspension apparatus 216 may be placed into the box 202. For example, as shown in FIGS. 2A-2C, the suspension apparatus 216 is positioned in the interior 204 of the box 202 with the face 116 of the base 104 facing the bottom 218 of the box 202. According to various approaches, the suspension apparatus 216 does not impede the top 208 of the box 202 from transitioning into a closed position. It should be noted however, when the box 202 is in the closed position, the base 104 of the suspension apparatus 216 may about contact and/or contact the top 208 of the box 202. Accordingly, the suspension apparatus 216 may be reinforced from easily sliding about the box 202 during shipping.

Moreover, in one specific approach, the foldable sections 106, 108 residing folded toward the back 124 of the base 104 may provide a buffer between the center portion 118 of the base 104 and the top 208 of the box 202. This buffer may provide additional protection of the item 102 during shipping by distancing the item 102 from the top 208 of the box 202.

Referring now to FIG. 2C, an enlarged view of apparatus 200 taken from circle 2C of FIG. 2B is illustrated. For example, the engagement of one the members 114 with one of the perforations 122 of the perforated sheet 120 is readily visible in the enlarged view.

Figure 3:
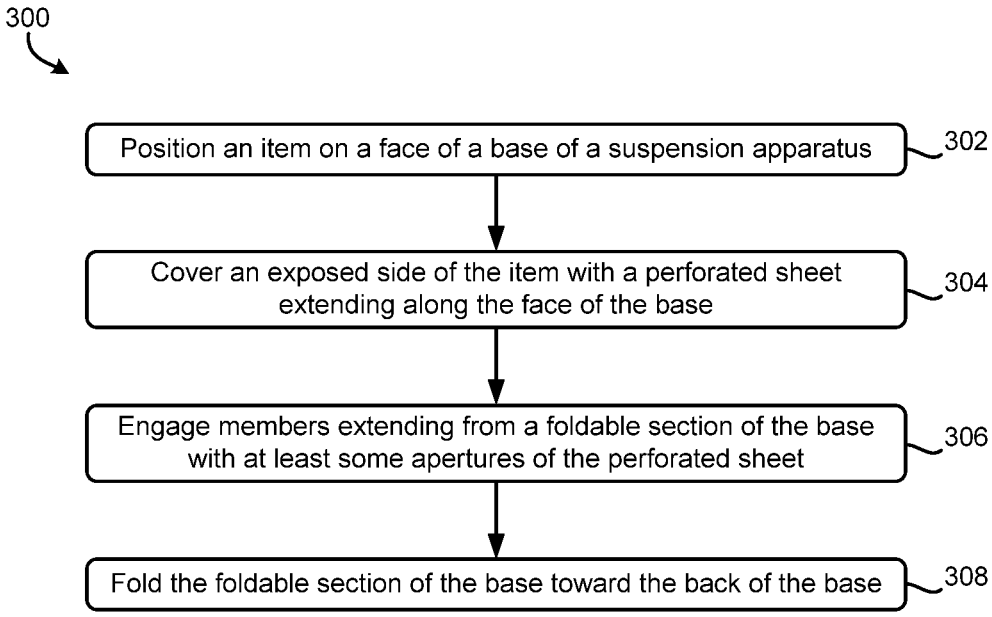
FIG. 3 is a flowchart of a method.

FIG. 3 shows a method 300 for packaging an item in a suspension apparatus, in accordance with one embodiment. As an option, the present method 300 may be implemented to apparatuses such as those shown in the other FIGS. described herein. Of course, however, this method 300 and others presented herein may be used to protect an item from being damaged during shipping which may or may not be related to the illustrative embodiments listed herein. Further, the methods presented herein may be carried out in any desired environment. Moreover, more or less operations than those shown in FIG. 3 may be included in method 300, according to various embodiments. It should also be noted that any of the aforementioned features may be used in any of the embodiments described in accordance with the various methods.

Method 300 may be initiated with operation 302 which includes positioning an item on a face of a base of a suspension apparatus. The suspension apparatus may have any configuration disclosed herein, in some approaches. For example, in one approach, the item may be positioned on the center section on the face of the base, e.g., similar to the approach shown in FIG. 1A.

With continued reference to method 300, operation 304 includes covering an exposed side of the item with a perforated sheet extending along the face of the base. Accordingly, the item may be sandwiched between the face of the base and the perforated sheet.

The perforated sheet may have any configuration disclosed herein, in some approaches. According to various approaches, the perforated sheet may include any type of perforations. For example, according to one approach, the perforated sheet may include regularly spaced apertures across an entire area thereof. Accordingly, to another approach, the perforated sheet may be netting.

The spatial dimensions of the perforated sheet may vary depending on the approach. For example, in one approach, the perforated sheet may be at least as spatially large as the face of the base in at least one dimension. According to another approach, the perforated sheet may be larger than the face of the base in at least one dimension. It should be noted however, that the spatial dimensions of the perforated sheet are preferably large enough to not impede other operations of method 300 from being performed, e.g., such as the engagement of operation 306.

Moreover, in some approaches, spatial dimensions of the perforated sheet may be determined in method 300 based on the spatial dimensions of the base. For example, method 300 may optionally include determining a size of a perforated sheet to use in packaging the item in the suspension apparatus in response to determining the dimensions of the item and/or in response to determining the dimensions of the base used in method 300. In one approach, determining the size of a perforated sheet that should be used in packaging the item may include using a predetermined ratio that considers at least one of: one or more determined dimensions of the base, one or more dimensions of the item, one or more determined dimensions of a box in which the base will be placed, etc. In another approach, a larger section of perforated sheet may be cut to the appropriate size, e.g., from a roll or larger sheet of the perforated material.

Operation 306 of method 300 includes engaging members extending from a foldable section of the base with at least some apertures of the perforated sheet. As described elsewhere herein, the members may be any type of shape, e.g., rectangular or rounded protrusions, hooks, pins, triangle shaped fingers, etc., that allows the members to engage the perforations of the perforated sheet. Moreover, according to various approaches, the members engaging the perforations may include, e.g., each of the members passing through a different perforation, portions of the perforated sheet wrapping around the members, the members threading through multiple perforations, etc.

Operation 308 of method 300 includes folding the foldable section of the base toward the back of the base. According to one approach, tension may be applied to the perforated sheet as a result of the folding. Moreover, in another approach, the tension applied to the perforated sheet as a result of the folding may additionally allow suspending of the item, e.g., such as when the suspension apparatus is positioned face down in an interior of a box, e.g., see FIGS. 2A-2C.

With continued reference to method 300, in some approaches, the base of the suspension apparatus may include a second foldable section. In one approach, the second foldable section may extend from the center section in a direction opposite the foldable section. Moreover, the second foldable section may include members extending therefrom.

Accordingly, in such approaches, method 300 may include engaging members extending from a second foldable section of the base with at least some apertures of the perforated sheet.

In one approach, the second foldable section may be folded toward the back of the base. As a result of the folding of the second foldable section, tension may be applied to the perforated sheet.

In some approaches, the base of the suspension apparatus on which method 300 is performed may include third and fourth foldable sections. Accordingly, method 300 may additionally and/or alternatively include folding the third and/or fourth foldable sections of the base toward the face of the base. The third and/or fourth foldable sections of the base may be configured to suspend the center section of the base above a surface. For example, the center section of the base may be suspended above a bottom of a box that the suspension apparatus is placed in. Accordingly, method 300 may include positioning the suspension apparatus face down in an interior of a box. In one approach, in the folded position in the box, the third and fourth foldable sections may contact the bottom of the box and thereby suspend the center section of the base above the bottom of the box. Moreover, the item may be suspended in the perforated sheet above the bottom of the box, e.g., see FIGS. 2B-2C for purposes of an example.

Referring again to method 300, a lid of the box may be closed to enclose the suspension apparatus therein. According to one approach, the lid may have a periphery approximately equal to, e.g., slightly larger than or slightly smaller than, a periphery of the interior of the box. Moreover, method 300 may optionally include taping a flap of the lid to a portion of the box, e.g., for ensuring that the lid does not open during shipping.

Similar to various other approaches described herein, method 300 may be used to protect an item from being damaged during shipping. For example, in response to packaging an item in a suspension apparatus using operations of method 300, the item will be prevented from tearing through the materials that suspend the item when packaged in the box, even though the item has sharp corners, protruding pins, etc. Accordingly, the item will remain protected from impacting an interior surface of the box, which would otherwise damage the item.

Figure 4A:
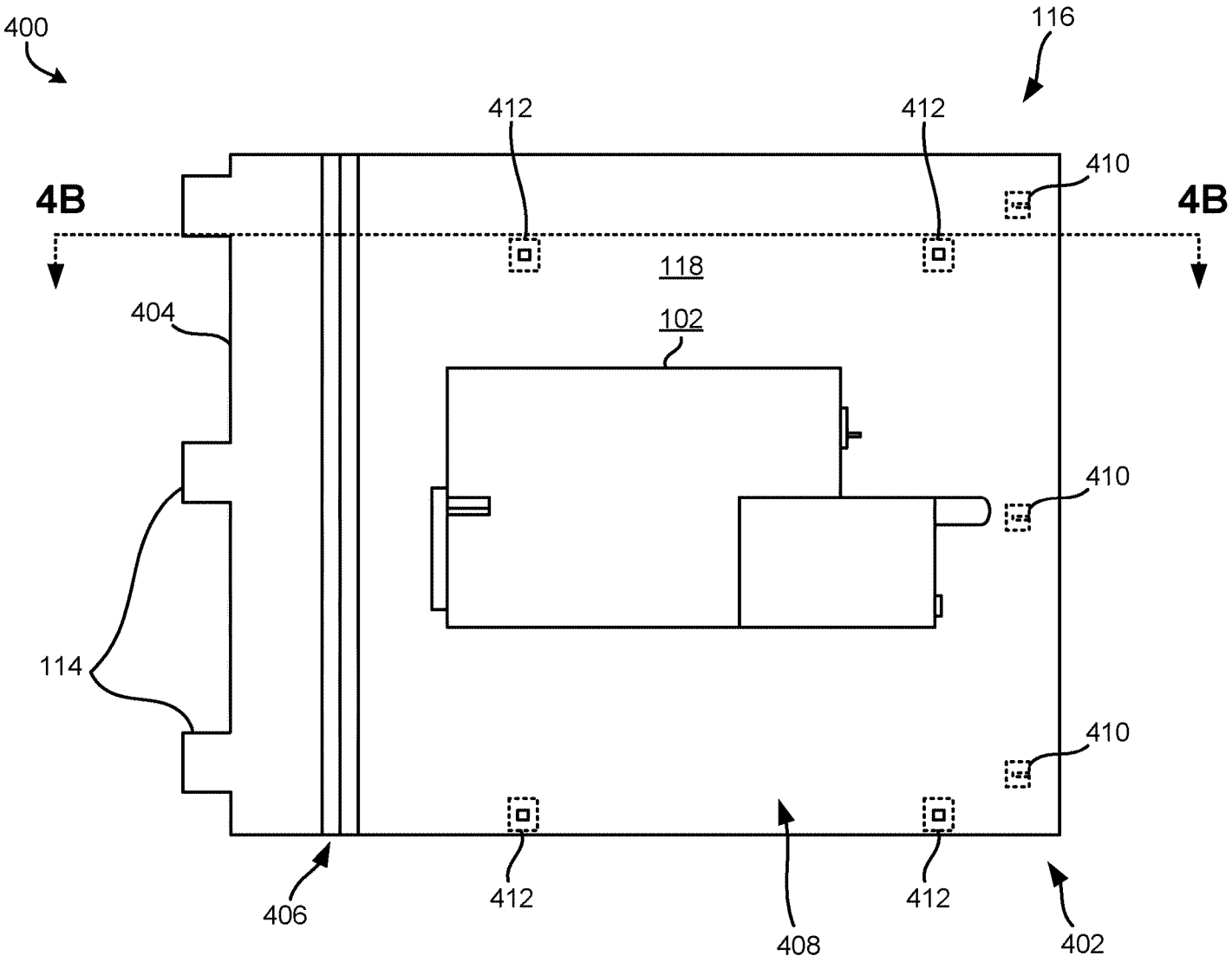
FIG. 4A is a face side view of a base and an item.
Figure 4B:
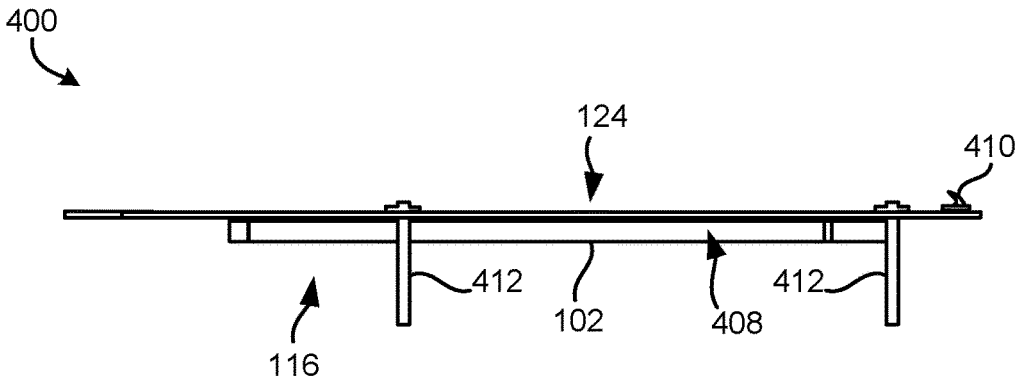
FIG. 4B is a side view of the base and the item taken along line 4B of FIG. 4A.
Figure 4C:
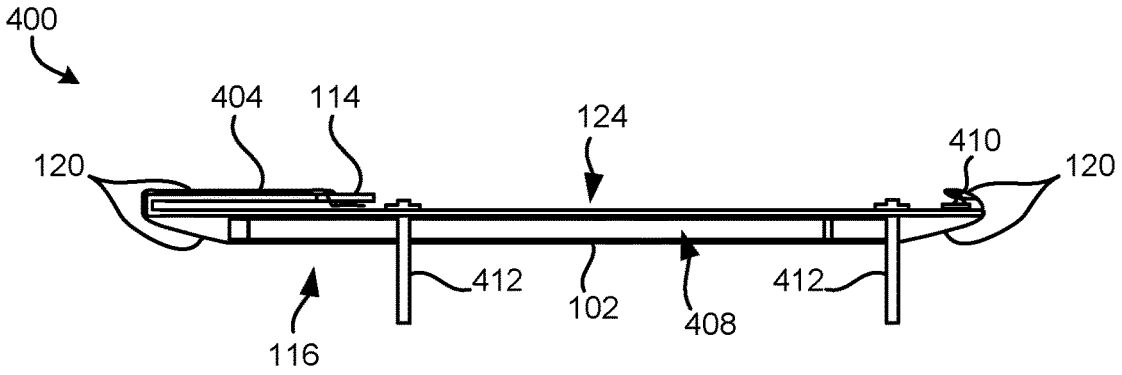
FIG. 4C is a side view of the base and the item of FIGS. 4A-4B, with a perforated sheet.
Figure 4D:
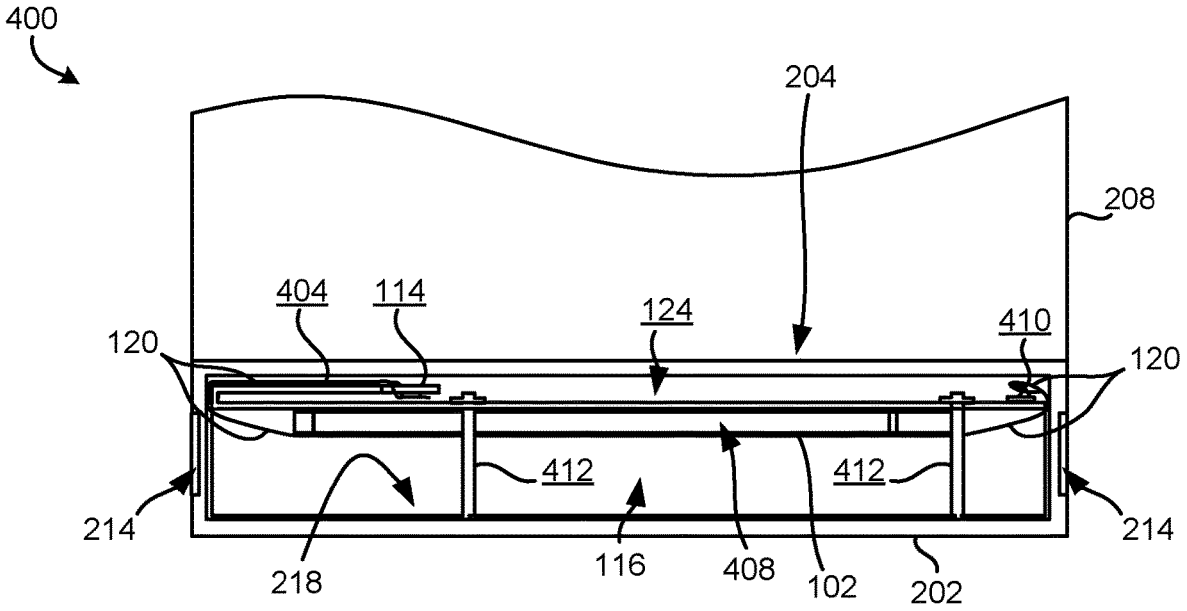
FIG. 4D is a cross sectional side view of the base and the item of FIGS. 4A-4C and a box.
Figure 5:
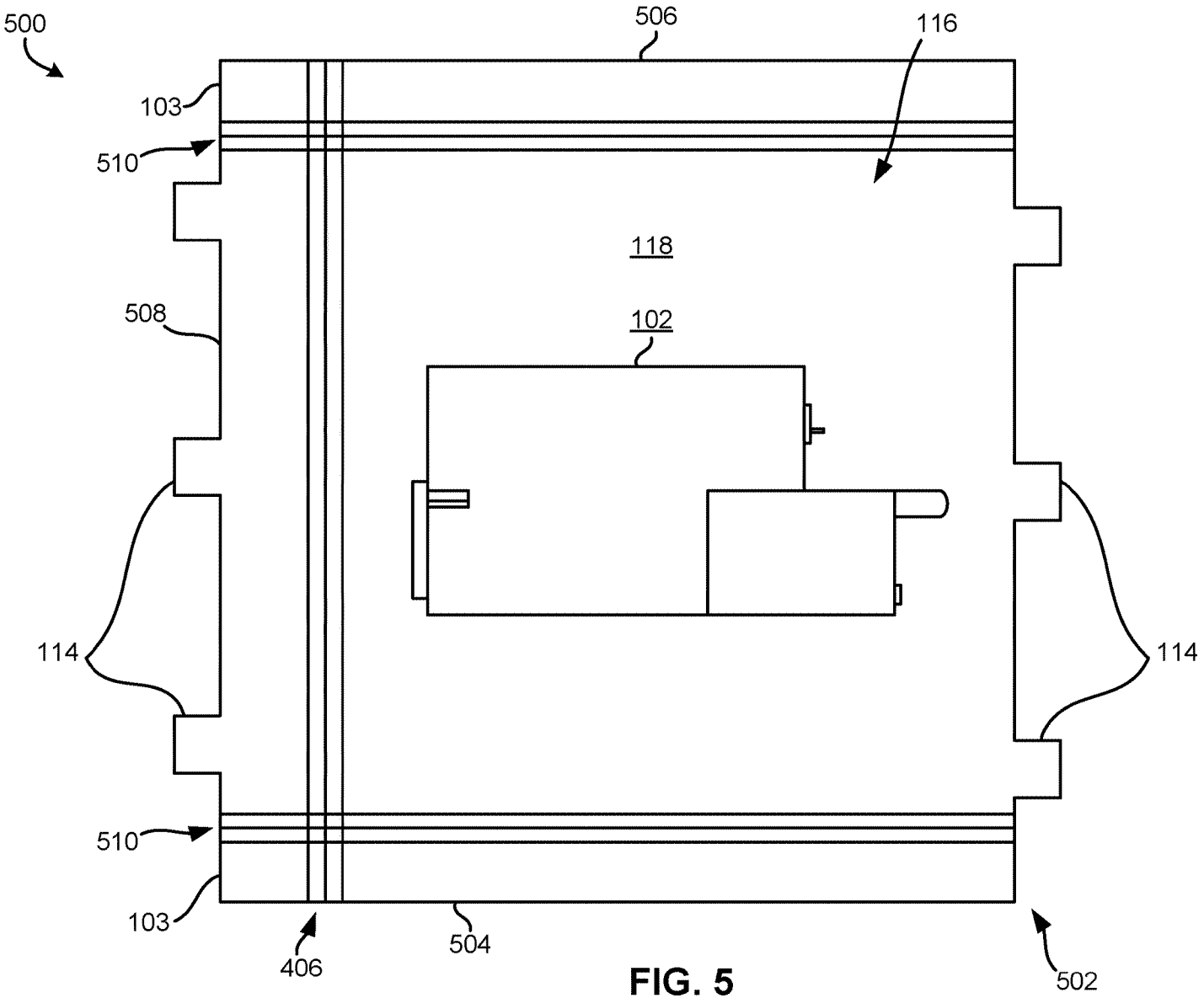
FIG. 5 is a face side view of a base and an item.

FIGS. 4A-5 depict apparatuses 400, 500, respectively, for preventing an item from being damaged during shipping. As an option, the present apparatuses 400, 500 may be implemented in conjunction with features from any other embodiment listed herein, such as those described with reference to the other FIGS. Of course, however, such apparatuses 400, 500 and others presented herein may be used in various applications and/or in permutations which may or may not be specifically described in the illustrative embodiments listed herein. Further, the apparatuses 400, 500 presented herein may be used in any desired environment.

It should be noted that apparatuses 400, 500 of FIGS. 4A-5 may have similar components as other apparatuses described elsewhere herein, e.g., apparatuses 100 and 200. Accordingly, reference numerals of various portions of apparatuses 400, 500 have common numbering with similar components of other apparatuses described elsewhere herein.

Referring now to FIG. 4A, apparatus 400 includes a base 402 having a single foldable section 404. According to one approach, the base 402 may include a plurality of creases 406, which may be used to vary the size of a center section 118 of the base 402, depending on which crease 406 is utilized when folding the foldable section 404 toward a back of the base 402. For example, the center section 118 of the base 402 will have a greater surface area as a result of the foldable section 404 being folded along the crease residing closest to members 114, than the surface area of the center section 118 that would result in response to the foldable section 404 being folded along the crease residing furthest from the members 114 in FIG. 4A.

It should be noted that the back of the base 402 resides on an opposite side of the base 402 as a face 116 of the base 408, e.g., see FIGS. 4B-4D.

Apparatus 400 further includes a plurality of hook members 410 configured to engage perforations of a perforated sheet, e.g., see FIGS. 4C-4D, thereby anchoring the perforated sheet to the base 408.

Similarly, the members 114 of the foldable section 404 may additionally and/or alternatively engage perforations of a perforated sheet. Moreover, in response to engagement of the perforations of a perforated sheet by the members 114 and/or the hook members 410, tension may be applied to the perforated sheet in response to the foldable section 404 being folded toward the back of the base 402.

Apparatus 400 further includes legs 412 extending from the base 402. The legs 412 may support the base 402 from a bottom of a box when placed face down in an interior of the box, e.g., see FIG. 4D.

Any known type of legs may be implemented. In some approaches, the legs 412 may be selectively coupled to the base 402. For example, as shown in FIGS. 4A-4D, the legs 412 may pass through apertures of the center section 118 of the base 402. In another example, the legs 412 may be clipped to an outer portion of the center section 118 of the base 402.

In other approaches, the legs 412 may be permanently coupled to the base 402. For example, in one approach the legs 412 may pass through apertures of the center section 118 of the base 402 where a portion of each of the legs 412 is adhered, e.g., stapled, glued, taped, etc., to a respective portion of the center section 118.

Referring now to FIG. 4C, apparatus 400 includes a perforated sheet 120. The foldable section 404 is shown folded toward the back of the base 402, and moreover, the perforated sheet 120 is shown engaged, e.g., within perforations of the perforated sheet 120, with both the hook members 410 and the members 114 of the foldable section 404. According to one approach, the hook members 410 may anchor a side of the perforated sheet 120 upon engaging with perforations of the perforated sheet 120. Accordingly, the foldable section 404 may be positioned to apply tension to the perforated sheet 120 upon folding of the foldable section 404 toward the back 124 of the base 402.

Referring now to FIG. 4D, it should be noted that the front facing side of box 202 has been omitted from view for viewing of the apparatus 400 and item 102 stored therein.

In various approaches, the perforated sheet 120 may suspend an item 102 above a bottom 218 of the box 202. For example, the perforated sheet 120 may suspend the item 102 above the bottom 218 of the box 202 when the apparatus 400 is positioned in an interior 204 of the box 202 with the face 116 of the base 402 facing the bottom 218 of the box 202. In suspension, the item 102 may be prevented from contacting any interior surface of the box, e.g., during shipping, which might otherwise result in the item 102 being damaged. Moreover, perforations of the perforated sheet 120 prevent any portions of the item 102, e.g., sharp edges, corners, pointed pieces, etc., from puncturing or tearing the perforated sheet 120, which might otherwise allow the item 102 to become at least partially free of the apparatus 400 and contact an interior surface of the box 202. Accordingly, apparatus 400 may reduce costs for, e.g., a manufacturer, a merchant, a consumer, etc., in preventing damage of suspended items during shipping.

It should be noted that although in the present approach, base 402 includes hook members 410 for anchoring a side of the perforated sheet 120 to the back 124 of the base 402, in other approaches, the apparatus 400 additionally and/or alternatively include any one or more of, e.g., staples, tape, glue, etc., for anchoring a portion or side of the perforated sheet to the back 124 or face 116 of the base 402.

Referring now to FIG. 5, apparatus 500 includes a base 502 having a face 116 and back (not shown but on an opposite side of the base as the face 116). Moreover, the base 502 includes a center section 118, and a foldable section 508 extending from the center section 118. Second and third foldable sections 504, 506 also extend from the center section 118.

In the present approach, the foldable section 508 and the base 502 include members 114 extending therefrom for engaging perforations of a perforated sheet placed over the base 502 (not shown).

In one approach, the foldable section 508 may be positioned to apply tension to the perforated sheet upon folding of the foldable section 508 toward the back of the base 502. Moreover, in such an approach, the members 114 of the base 502 may anchor the side of the perforated sheet that engages with the members 114 of the base 502. Accordingly, the members 114 of the base 502 may assist in the application of tension to the perforated sheet upon folding of the foldable section 508 toward the back of the base 502.

Moreover, the second and third foldable sections 504, 506 are configured to fold toward the face 116 of the base 502, e.g., to suspend the center portion 118 above the bottom of a box.

It should be noted that creases 406, 510 may be configured to enable selection of, e.g., increase or decrease, the spatial size of any one or more of the foldable sections 504, 506, 508, and the center portion 118. For example, in one approach, the center section 118 of the base 502 may have a greater surface area as a result of the foldable section 508 being folded along the crease 406 closest to members 114 of the foldable section 508. Accordingly, less spatial area will thereby be devoted to the foldable section 508.

According to various approaches, the apparatus 500 may be used to protect an item 102 from impact damage during shipping. For example, tension applied to the perforated sheet may retain, e.g., reinforce, suspend, cradle, etc., the item 102 that is sandwiched between the perforated sheet and the base 502, at about the location on the center portion 118 that the item 102 resided at upon tension being applied to the perforated sheet.

Moreover, in various approaches, apparatus 500 may be placed face down in an interior of a box during shipping of the item 102. In such approaches, the second and third foldable sections 504, 506 may suspend the item 102 from a bottom of the interior of the box. Retaining and/or suspending the item 102 at about the location relative to the center portion 118 that the item 102 resided at upon tension being applied to the perforated sheet, may prevent the item from contacting a surface, e.g., a sidewall of the box, which might otherwise damage the item 102. Of course preventing damage to the item 102 during shipping will result in reduced costs for a, e.g., a manufacturer, a merchant, a consumer, etc.

Moreover, because the dimensions of various portions of the base 502 are configured to selectively vary, e.g., as a result of the different creases 406, 510, the base 502 may be able to be form fit in accordance with boxes having different spatial dimensions, and/or form fit to for items of different sizes. These advantages may be particularly useful in streamlining the packaging of an item prior to shipping, because the base 502 is compatible with numerous box and/or item sizes.

Various embodiments described elsewhere herein, e.g., with respect to FIGS. 1A-3, may include creases between the center section and one or more foldable sections, e.g., to enable selection of sizes of various components, e.g., as described with reference to FIG. 5.

It will be clear that the various features of the foregoing systems and/or methodologies may be combined in any way, creating a plurality of combinations from the descriptions presented above. Each of said possible combinations is deemed an embodiment of the present invention.

It will be further appreciated that embodiments of the present invention may be provided in the form of a service deployed on behalf of a customer.

The inventive concepts disclosed herein have been presented by way of example to illustrate the myriad features thereof in a plurality of illustrative scenarios, embodiments, and/or implementations. It should be appreciated that the concepts generally disclosed are to be considered as modular, and may be implemented in any combination, permutation, or synthesis thereof. In addition, any modification, alteration, or equivalent of the presently disclosed features, functions, and concepts that would be appreciated by a person having ordinary skill in the art upon reading the instant descriptions should also be considered within the scope of this disclosure.

While various embodiments have been described above, it should be understood that they have been presented by way of example only, and not limitation. Thus, the breadth and scope of an embodiment of the present invention should not be limited by any of the above-described exemplary embodiments, but should be defined only in accordance with the following claims and their equivalents.

What is claimed is:

1. An apparatus, comprising:

a base having a face and back, a center section, and first, second and third foldable sections extending from the center section;

a perforated sheet extending along the face of the base; and members extending from the first foldable section along a plane thereof, the members configured to engage perforations of the perforated sheet, wherein respective widths of the members measured along the plane are greater than a nominal width of the perforations measured along the plane, wherein the first foldable section is positioned to apply tension to the perforated sheet upon folding of the first foldable section toward the back of the base, wherein the second and third of the foldable sections are positioned to fold toward the face of the base, wherein the first foldable section has rectangular portions positioned toward opposite ends thereof, wherein the portions are configured to travel with the first foldable section toward the back of the base to a first position, and the portions are further configured to travel from the first position toward the face of the base with the second and third foldable sections, wherein the perforated sheet has regularly spaced apertures across an entire area thereof, wherein the entire area is defined by a periphery of the perforated sheet.

2. An apparatus, comprising:

a box; and a suspension apparatus configured to be positioned in an interior of the box, the suspension apparatus comprising:

a base having a face and back, a center section having a periphery approximately equal to a periphery of the interior of the box, a foldable section extending from the center section, a perforated sheet extending along the face of the base, members extending from the foldable section, wherein the members are configured to engage perforations of the perforated sheet, and a suspension portion configured to suspend the center section above a bottom of the box, the foldable section being positioned to apply tension to the perforated sheet upon folding of the foldable section toward the back of the base, wherein the base and perforated sheet are configured to selectively allow loose suspension of an item during engagement of the members with a first set of the perforations of the perforated sheet such that a gap is created between the item and the face of the base upon folding of the foldable section toward the back of the base, wherein the base and perforated sheet are configured to selectively retain a positioning of the item between the base and perforated sheet during engagement of the members with a second set of the perforations of the perforated sheet such that the item remains in contact with the face of the base upon folding of the foldable section toward the back of the base.

3. An apparatus as recited in claim 2, comprising a second foldable section extending from the center section in a direction opposite the foldable section, the second foldable section having members configured to engage the perforations of the perforated sheet, the second foldable section being positioned to apply tension to the perforated sheet upon folding of the second foldable section toward the back of the base.

4. An apparatus as recited in claim 2, wherein the members are fingers extending outwardly from the foldable section along a plane thereof.

5. An apparatus as recited in claim 2, wherein the perforated sheet has regularly spaced apertures across an entire area thereof.

6. An apparatus as recited in claim 2, wherein the perforated sheet is netting, wherein the back of the base includes a coupling component configured to selectively couple the foldable section to the back of the base, wherein an entirety of the foldable section is positioned parallel with the back of the base when coupled to the back of the base.

7. An apparatus as recited in claim 2, wherein the suspension apparatus is positioned in the interior of the box with the face of the base facing the bottom of the box.

8. An apparatus as recited in claim 2, wherein the suspension portion includes second and third foldable sections extending from the base and foldable toward the face of the base.

9. An apparatus as recited in claim 2, wherein the suspension portion includes legs extending from the base.

10. An apparatus, comprising:

a base having a face and back, a center section, and a foldable section extending from the center section;

a perforated sheet extending along the face of the base, the perforated sheet including some perforations residing closer to an outer circumference of the perforated sheet than other perforations to enable accommodation of differently sized items;

members extending from the foldable section, the members configured to engage the perforations of the perforated sheet; and a second foldable section extending from the center section in a direction opposite the foldable section, the second foldable section having members configured to engage the perforations of the perforated sheet, the second foldable section being positioned to apply tension to the perforated sheet upon folding of the second foldable section toward the back of the base, the foldable section being positioned to apply tension to the perforated sheet upon folding of the foldable section toward the back of the base, wherein the back of the base includes an adhesive strip configured to selectively couple the foldable section directly to the back of the base, wherein an entirety of the foldable section is positioned parallel with the back of the base when coupled to the back of the base, wherein the second foldable section includes a second adhesive strip configured to selectively couple the second foldable section directly to the back of the base, wherein an entirety of the second foldable section is positioned parallel with the back of the base when coupled to the back of the base, wherein the members of the foldable section are fingers extending outwardly from the foldable section along a first plane thereof, wherein the members of the second foldable section are fingers extending outwardly from the second foldable section along a second plane thereof, wherein the first plane and the second plane are substantially coplanar when the second foldable section and the foldable section are coupled to the back of the base.

11. An apparatus as recited in claim 10, wherein the members are fingers extending outwardly from the foldable section along a plane thereof.

12. An apparatus as recited in claim 10, wherein the perforated sheet is netting.

13. An apparatus as recited in claim 10, wherein the base has third and fourth foldable sections configured to fold toward the face of the base.

14. An apparatus as recited in claim 13, comprising: a plurality of portions, wherein some of the portions are configured to travel with the foldable section toward the back of the base to a first position, and the some of the portions are further configured to travel from the first position toward the face of the base with the third of the foldable sections, wherein a remainder of the portions are configured to travel with the second foldable section toward the back of the base to a second position, and the remainder of the portions are further configured to travel from the second position toward the face of the base with the fourth of the foldable sections, wherein the some of the portions are rectangular in shape.

15. An apparatus as recited in claim 10, wherein a width of the members of the foldable section is greater than a nominal width of the perforations, wherein the width of the members and the nominal width are measured along the first plane.

16. A method of packaging an item in the apparatus of claim 10, the method comprising:

positioning an item on the face of the base of the apparatus;

covering an exposed side of the item with the perforated sheet, engaging the members extending from the foldable section of the base with the perforations of the perforated sheet; and folding the foldable section of the base toward the back of the base, wherein tension is applied to the perforated sheet as a result of the folding.

17. A method as recited in claim 16, comprising:

engaging members extending from a second foldable section of the base with at least some apertures of the perforated sheet; and folding the second foldable section of the base toward the back of the base, wherein tension is applied to the perforated sheet as a result of the folding of the second foldable section.

18. A method as recited in claim 16, comprising:

folding third and fourth foldable sections of the base toward the face of the base; and positioning the apparatus in an interior of a box, wherein in the interior of the box, the third and fourth foldable section suspend the center section above a bottom of the box.

19. A kit, comprising:

an item;

a box; and the apparatus as recited in claim 10, the apparatus suspending the item above a bottom of the box, the foldable section being folded toward the back of the base thereby applying tension to the perforated sheet and an exposed side of the item positioned on the face of the base, wherein the perforated sheet has regularly spaced apertures across an entire area thereof, wherein corners of the item pass through some of the apertures of the perforated sheet as a result of the tension, thereby preventing the item from contacting an interior of the box.

* * * * *